US011203875B2

(12) United States Patent
Bladh

(10) Patent No.: US 11,203,875 B2
(45) Date of Patent: Dec. 21, 2021

(54) SET OF TILES ADAPTED TO COVER A SURFACE SUCH AS A FLOOR

(71) Applicant: TARKETT GDL S.A., Lentzweiler (LU)

(72) Inventor: Jonas Bladh, Wiltz (LU)

(73) Assignee: TARKETT GDL S.A., Lentzweiler (LU)

( * ) Notice: Subject to any disclaimer, the term of this patent is extended or adjusted under 35 U.S.C. 154(b) by 0 days.

(21) Appl. No.: 16/978,396

(22) PCT Filed: Mar. 4, 2019

(86) PCT No.: PCT/EP2019/055322
§ 371 (c)(1),
(2) Date: Sep. 4, 2020

(87) PCT Pub. No.: WO2019/170605
PCT Pub. Date: Sep. 12, 2019

(65) Prior Publication Data

US 2021/0054631 A1 Feb. 25, 2021

(30) Foreign Application Priority Data

Mar. 5, 2018 (EP) ..... 18160025

(51) Int. Cl.
*E04F 13/08* (2006.01)
*E04F 13/18* (2006.01)
(Continued)

(52) U.S. Cl.
CPC ..... *E04F 13/0866* (2013.01); *E04F 13/0894* (2013.01); *E04F 13/18* (2013.01);
(Continued)

(58) Field of Classification Search
CPC ..... E04F 15/02038; E04F 2201/0547; E04F 2201/0138; E04F 2201/044; E04F 2201/0523; E04F 2201/0115
See application file for complete search history.

(56) References Cited

U.S. PATENT DOCUMENTS 8,904,729 B2 * 12/2014 Thiers ..... B32B 21/042 52/591.1
10,995,499 B2 * 5/2021 De Rick ..... E04F 15/02038
(Continued)

FOREIGN PATENT DOCUMENTS

DE 102005044185 3/2007
EP 2060389 5/2009

OTHER PUBLICATIONS

Written Opinion of the International Searching Authority for PCT/EP2019/055322, dated May 9, 2019.
(Continued)

*Primary Examiner* — Gisele D Ford
(74) *Attorney, Agent, or Firm* — B. Aaron Schulman, Esq.; Stites & Harbison, PLLC

(57) ABSTRACT

A set (1) of tiles (5) adapted to cover a surface (10) perpendicular to a thickness direction (V) of the tiles (5), each of the tiles comprising at least one upper layer (24), and an underlying rigid core layer (22), the core layer and the upper layer being superimposed in the thickness direction, and the core layer defining a lower surface (S) opposite the upper layer. The tiles comprise at least one first tile (15) having a first edge extending in a longitudinal direction (L), the core layer of the first tile (15) defining a connecting groove (28) in the first edge. The tiles comprise at least one second tile (20) having a second edge extending in the longitudinal direction, the core layer of the second tile defining a connecting tongue (34) protruding from the second edge, the connecting tongue being adapted to be
(Continued)

snap-fit into the connecting groove in a connecting direction (C) perpendicular to the longitudinal direction (L) and to the thickness direction in a locked configuration of the first tile and the second tile. The lower surface defines an additional groove (30) parallel to the first edge.

15 Claims, 4 Drawing Sheets

(51) Int. Cl.
*E04F 15/02* (2006.01)
*E04F 15/10* (2006.01)

(52) U.S. Cl.
CPC ..... *E04F 15/02038* (2013.01); *E04F 15/105* (2013.01); *E04F 15/107* (2013.01); *E04F 2201/0115* (2013.01)

(56) References Cited

U.S. PATENT DOCUMENTS

2003/0205017 A1* 11/2003 Palmberg ..... E04F 15/02 52/592.1
2004/0031226 A1* 2/2004 Miller ..... E04F 15/04 52/588.1
2005/0144881 A1* 7/2005 Tate ..... E04F 15/10 52/578
2006/0010820 A1* 1/2006 Schwitte ..... E04F 13/0826 52/592.1
2009/0041987 A1* 2/2009 Schitter ..... B32B 9/06 428/172
2009/0223162 A1 9/2009 Chen et al.
2013/0333182 A1* 12/2013 Pervan ..... E04F 15/02038 29/426.2
2014/0109507 A1* 4/2014 Dossche ..... B32B 29/00 52/588.1
2015/0218812 A1* 8/2015 Kell ..... E04F 15/02038 428/99
2016/0053496 A1* 2/2016 Sosnowski ..... B32B 5/02 52/588.1
2016/0273230 A1* 9/2016 Yang ..... E04F 15/02038
2016/0288447 A1* 10/2016 Cordeiro ..... B32B 9/025
2017/0009462 A1* 1/2017 Muehlebach ..... E04F 15/107
2017/0030088 A1* 2/2017 Simoens ..... B21D 47/00
2018/0135312 A1* 5/2018 Schafer ..... B32B 3/06

OTHER PUBLICATIONS

International Search Report for PCT/EP2019/055322, dated May 9, 2019.

* cited by examiner

SET OF TILES ADAPTED TO COVER A SURFACE SUCH AS A FLOOR

BACKGROUND OF THE INVENTION

Field of the Invention

The present invention deals with a set of tiles adapted to cover a surface perpendicular to a thickness direction of the tiles, each of the tiles comprising at least one upper layer, and an underlying rigid core layer, the core layer and the upper layer being superimposed in the thickness direction, and the core layer defining a lower surface opposite the upper layer.

Such a surface is for example a floor or a wall.

The present invention also deals with a corresponding method of covering such a surface.

Description of Related Art

Such tiles may have various shapes, such as rectangular or square. They are based on synthetic materials, with a rigid core layer supporting at least one upper layer, usually several ones, intended to be visible by users once the tiles are in place. Such tiles are known as vinyl tiles, also called LVT (Luxury Vinyl Tiles).

The core layer brings rigidity to these tiles. In order to interconnect the tiles, it is known to provide them with a first kind of hooks, for example located on two consecutive edges of a rectangular tile, and a second kind of hooks on the two remaining edges. The hooks of the first kind cooperate with those of the second kind in order to lock the tiles next to each other. In order to put two adjacent tiles in a locked configuration at least, one of the tiles usually has to be raised from the surface and/or the other one has to be put an angle with respect to the other in order to allow matching the two kinds of hooks.

In particular, it is not possible to put two adjacent tiles in the locked configuration by a relative translation movement of the tiles parallel to the surface to be covered. If this was possible, the opposite movement would also be possible and there would be no locked configuration. As a consequence, a drawback of these tiles is that connecting them is complex and sometimes tiring for the user.

Besides, using a snap-fit locking system between the tiles is not an option, as the core layer is actually too stiff to allow a reasonable insertion effort. In other words, due to the rigidity of the core layer of such tiles, it would be mechanically too difficult for a user to snap-fit one tile in another, or to separate them.

An aim of the invention is to provide a set of tiles that solves or reduces these problems, while remaining simple to produce, and cost effective.

BRIEF SUMMARY OF THE INVENTION

To this end, the invention proposes a set of tiles adapted to cover a surface perpendicular to a thickness direction of the tiles, each of the tiles comprising at least one upper layer, and an underlying rigid core layer, the core layer and the upper layer being superimposed in the thickness direction, and the core layer defining a lower surface opposite the upper layer, wherein:

- the tiles comprise at least one first tile having a first edge extending in a longitudinal direction, the core layer of the first tile defining a connecting groove in the first edge,

- the tiles comprise at least one second tile having a second edge extending in the longitudinal direction, the core layer of the second tile defining a connecting tongue protruding from the second edge, the connecting tongue being adapted to be snap-fit into the connecting groove in a connecting direction perpendicular to the longitudinal direction and to the thickness direction in a locked configuration of the first tile and the second tile, and
- the lower surface defines an additional groove parallel to the first edge.

In other embodiments, the set of tiles comprises one or several of the following features, taken in isolation or any technically feasible combination:

- the core layer comprises a thermoplastic material;
- the thermoplastic material comprises PVC;
- the connecting groove has a depth in the connecting direction, the additional groove being located at a distance from the first edge, the distance being smaller than twice the depth;
- the additional groove has a "U"-shaped profile in section perpendicularly to the longitudinal direction;
- the connecting groove comprises a bottom having a "U"-shaped profile seen in the longitudinal direction, said "U" opening toward the first edge;
- said "U"-shaped profile of the bottom of the connecting groove has a lower side located at a reference distance from the lower surface in the thickness direction away from the additional groove, the additional groove having a depth in the thickness direction, said depth being smaller than 75% of said reference distance;
- the additional groove has a "U"-shaped profile having a distal side with respect to the first edge in the connecting direction, the connecting groove defines a lower contact surface adapted to be at least partly in contact with the connecting tongue in the locked configuration, the lower contact surface having a lowermost point in the thickness direction, said "U"-shaped profile of the bottom of the connecting groove has a distal side defining a reference plane perpendicularly to the connecting direction, and the distal side of the "U"-shaped profile of the additional groove is located between a first plane and a second plane both parallel to the reference plane, the second plane containing the lowermost point, the reference plane being located in between the first plane and the second plane, and the first plane being located at said reference distance from the reference plane;
- the connecting groove defines a lower contact surface adapted to be at least partly in contact with the connecting tongue in the locked configuration, and the lower contact surface of the connecting grove has a locking part adapted to abut against a matching surface of the connecting tongue when the second tile is moved away from the first tile in the connecting direction starting from the locked configuration;
- the lower contact surface of the connecting grove also has a blocking part adapted to abut against a matching surface of the connecting tongue when the second tile is moved toward the first tile in the connecting direction starting from the locked configuration, the locking surface and the blocking surface are in contact respectively with said matching surfaces in the locked configuration, and the locking surface and the blocking surface are inclined with respect to the thickness direction so as to block the connecting tongue with respect to the connecting groove in the locked configuration when a pressure is applied on the upper layer of the first tile in the thickness direction toward the connecting groove;

the core layer contains no plasticizer, or less than 5 wt % of plasticizer;

the core layer has a rigidity represented by an angle, the angle being smaller than or equal to 2°, wherein:

a sample is prepared, wherein the sample is in the same material and has the same thickness as the core layer, the sample is rectangular and measures 450 mm×160 mm, a rectangular part of the sample is blocked in between a horizontal support and a weight of 5 kg in an atmosphere regulated at 23° C.+/−2° C., a rest of the sample is delimited by a linear edge of the support, wherein the rest measures 300 mm×160 mm, and wherein the rest, horizontal at an initial time, is cantilevered and flexes downwards under its own weight, a lowest point of the rest and the edge define the angle with respect to a horizontal direction, and the angle is measured 30 seconds after the initial time;

the at least one upper layer is a decorative layer located on the core layer, the tiles further comprising a wear layer located on the print layer, and optionally a backing layer fixed to the core layer opposite the decorative layer; and the backing layer of the first tile comprises a flat portion covering the additional groove like a bridge.

The invention also deals with a method of covering a surface with tiles, the surface being perpendicular to a thickness direction of the tiles, comprising at least the following steps:

providing a set as described above, and putting the first tile and the second tile in the locked configuration by snap-fitting the connecting tongue into the connecting groove in the connecting direction.

BRIEF DESCRIPTION OF THE SEVERAL VIEWS OF THE DRAWINGS

The invention and its advantages will be better understood upon reading the following description, given solely by way of example and with reference to the appended drawings, in which.

DETAILED DESCRIPTION OF THE INVENTION

Figure 1:
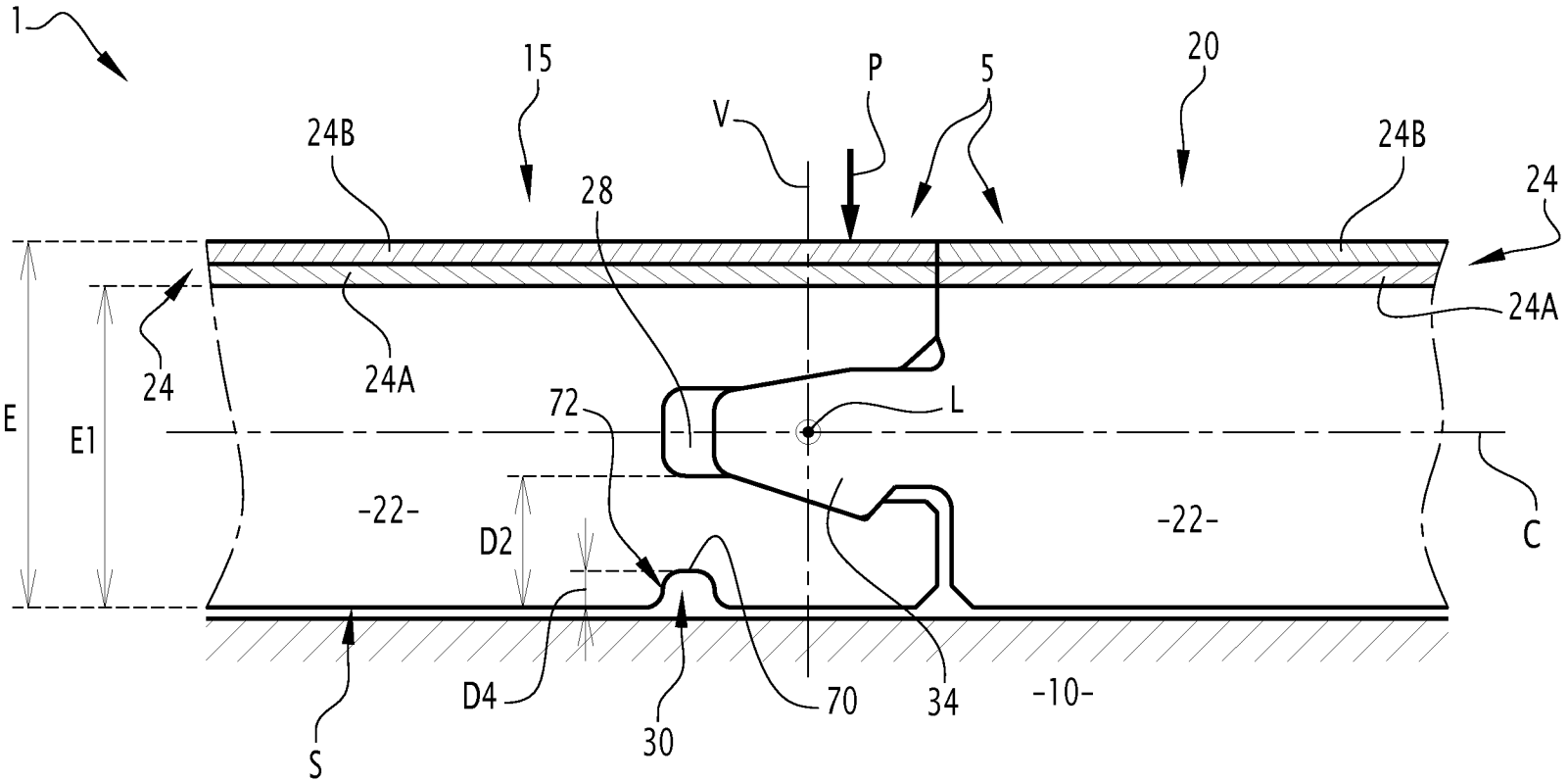
FIG. 1 is a schematic cross-sectional view of a set of tiles according to the invention, the first tile and the second tile being in a locked configuration.
Figure 2:
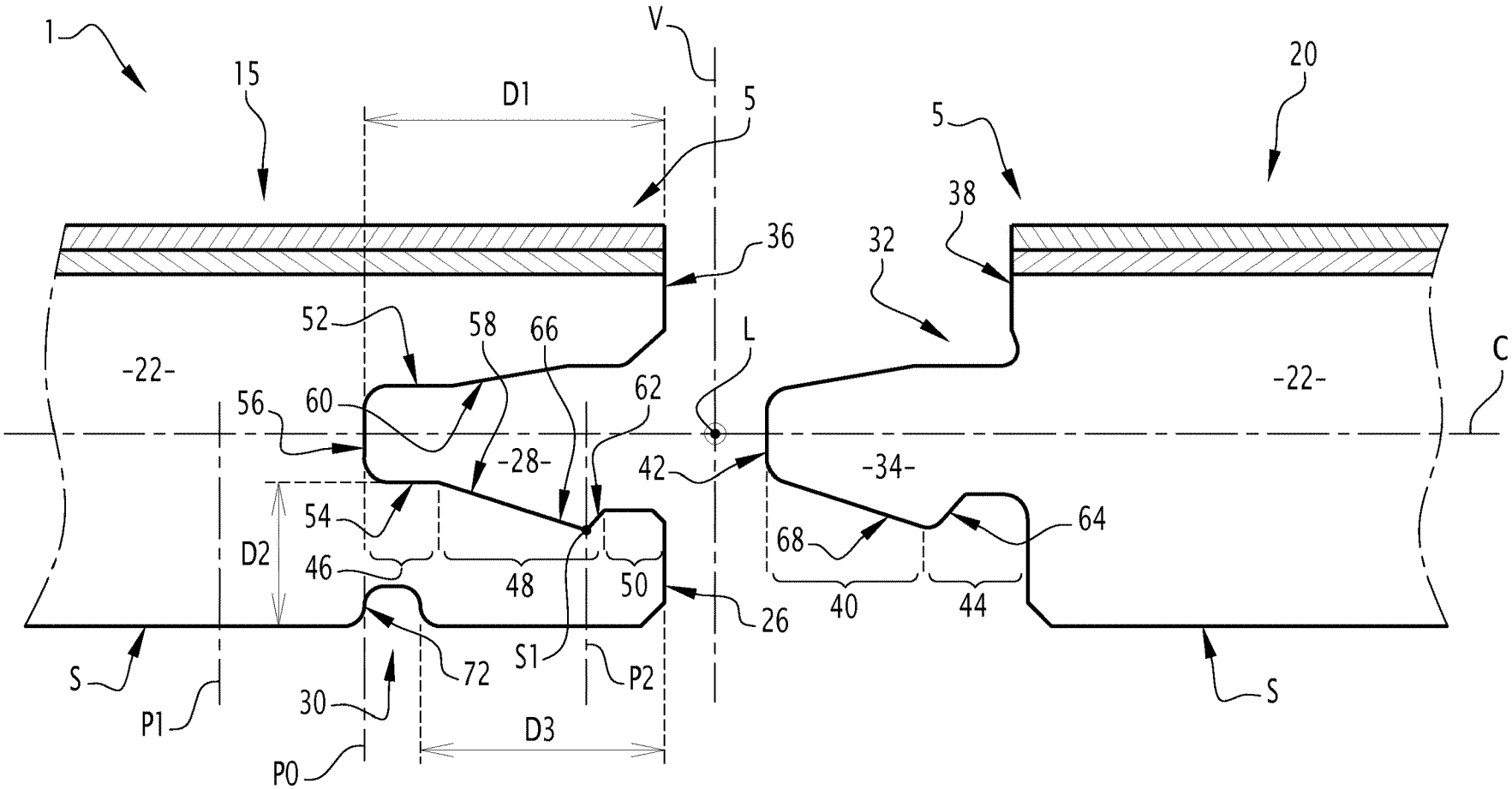
FIG. 2 is a schematic cross-sectional view of the set of tiles shown in FIG. 1, except the tiles are spaced apart and not in a locked configuration.

A set 1 of tiles 5 according to the invention is represented in FIGS. 1 and 2.

The set 1 comprises many tiles, of which only two are shown. The set 1 is for example adapted to cover a surface 10 (FIG. 1), such as a floor or a wall, which is approximately perpendicular to a thickness direction V of the tiles 5 and vertical in the example.

The tiles 5 comprise a first tile 15 and a second tile 20 adapted to be connected to each other in a locked configuration shown in FIG. 1, whereas they are unlocked in FIG. 2.

The tiles 5 have a same thickness E in the thickness direction V, for example comprised between 3.0 and 8.0 mm. Each of the tiles 5 comprises a core layer 22, and two upper layers 24, for example a decorative layer 24A located on the core layer, and a wear layer 24B located on the decorative layer.

"Upper" and "lower" here respectively mean "towards the surface 10" and" opposite the surface 10" in the thickness direction V.

The tiles 5, as seen in the thickness direction V, are for example rectangular or square, possibly with the same dimensions.

The core layer 22, and the upper layers 24 are superimposed in the thickness direction. Advantageously these layers are laminated to each other.

The core layer 22 is rigid.

Figure 4:
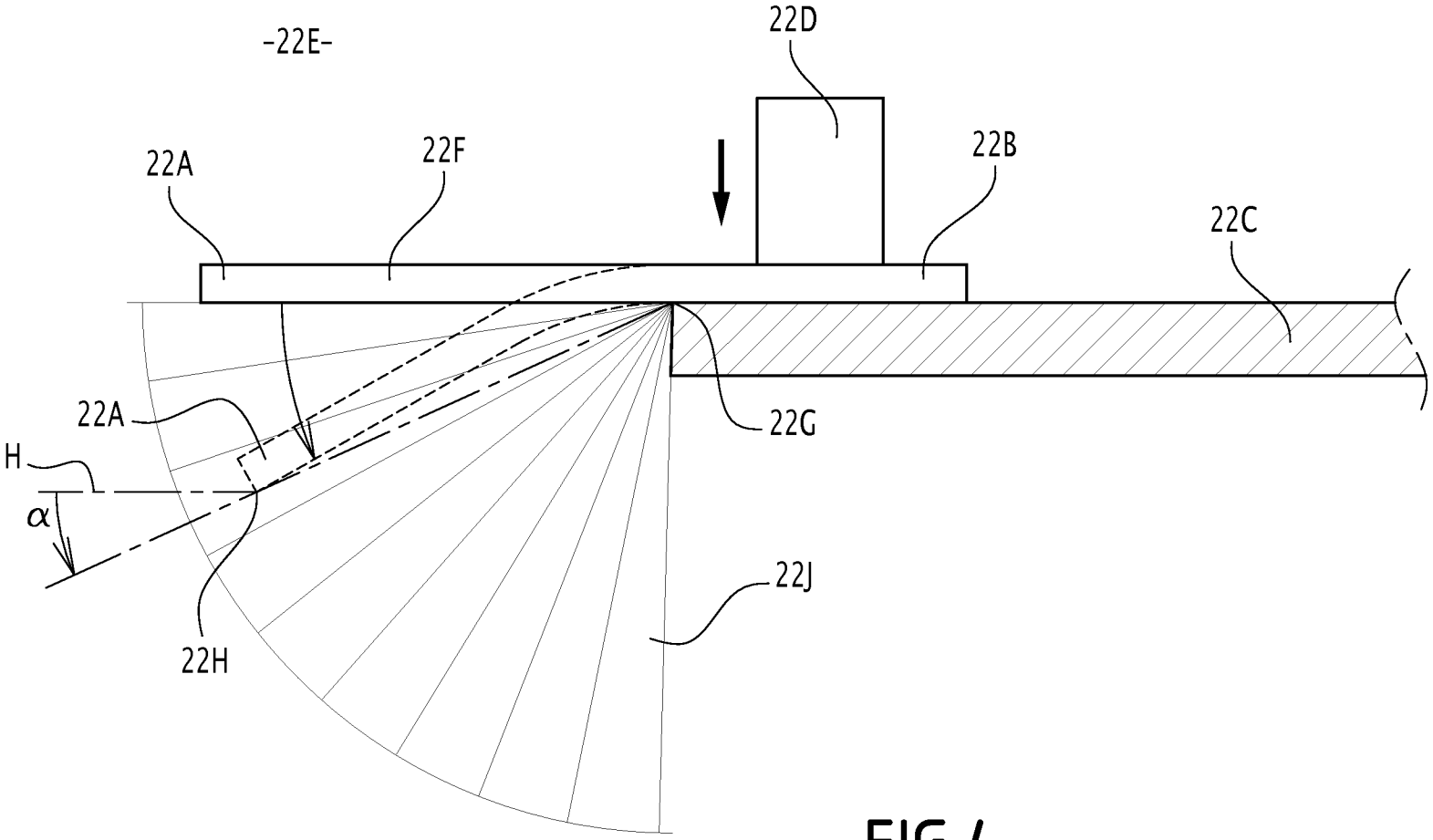
FIG. 4 is a schematic view of a way to assess the rigidity of the core layer.

For example, the rigidity of the core layer 22 is assessed as follows with reference to FIG. 4.

A sample 22A in the same material and having the same thickness as the core layer 22 is prepared. For example, the sample 22A is rectangular and advantageously measures 450 mm×160 mm. A rectangular part 22B of the sample is blocked in between a horizontal support 22C and a weight 22D of about 5 kg in an atmosphere 22E regulated at 23° C.+/−2° C. The rest 22F of the sample 22A is delimited by a linear edge 22G of the support 22C. The rest 22F is rectangular and for example measures 300 mm×160 mm.

The rest 22F, horizontal at an initial time, is cantilevered and flexes downwards under its own weight.

The lowest point 22H of the rest 22F and the edge 22G define an angle $\alpha$ with a horizontal direction H. The angle $\alpha$ is measured for example after 30 seconds after the initial time. The angle $\alpha$ is advantageously read on a vertical grid 22J forming a protractor, for example with a 90° span.

The duration of 30 seconds has been chosen to ensure that flexion of the rest (22F) is completed.

The angle $\alpha$ is advantageously representative of the rigidity of the core layer 22.

For a rigid core 22, the angle $\alpha$ is for example smaller than or equal to 2°.

The core layer 22 comprises at least one thermoplastic material, advantageously PVC (polyvinyl chloride), of which content is for example between 15 and 40 wt %.

As an alternative, the core layer 22 does not contain PVC. In this case the at least one thermoplastic material is chosen among PVB (Polyvinylbutyrate), polyolefins.

The core layer 22 advantageously contains less than 5 wt % of plasticizer, and for example no plasticizer at all.

The skilled person knows how to adjust the rigidity of the core layer 22, by selecting its components, particularly the amount of plasticizer.

For example, the core layer 22 has a composition as specified in the below table 1

TABLE 1 composition of the core layer 22.

| | Material | Name | Supplier | PHR | % |
|---|---|---|---|---|---|
| 1 | PVC | Vynova 5730 | Vynova | 100 | 27.8 |
| 2 | CaCO3 Filler | OMYA VS35 | OMYA | 250 | 69.5 |
| 3 | Stabilizer | Baeropan | Baerlocher | 4.5 | 1.3 |

TABLE 1-continued composition of the core layer 22.

| | Material | Name | Supplier | PHR | % |
|---|---|---|---|---|---|
| | | 90704P | | | |
| 4 | Processing aid (CPE) | Durastrength 200 or 3000 | Arkema | 3.0 | 0.8 |
| 5 | Processing Aid | Plastistrength 530 | Arkema | 1.0 | 0.3 |
| 6 | Processing aid (PE Wax) | A-C629 | Honeywell | 0.5 | 0.1 |
| 7 | Processing aid (Stearic Acid) | Stearina RG | Brentag | 0.5 | 0.1 |
| | | | Total: | 359.5 | 100.0 |

The core layer 22 has a thickness E1, for example comprised between 2 and 5 mm.

The decorative layer 24A for example comprises a printed décor (not shown). The decorative layer 24A for example comprises 90 wt % of a thermoplastic material, for example PVC, 10% of additive, and no plasticizer.

The wear layer 24B is adapted to protect the decorative layer 24A. The wear layer 24A for example comprises 80 wt % of a thermoplastic material, for example PVC, 20% of additive, and no plasticizer.

The first tile 15 has a first edge 26 ("first" refers here to the first tile, and not to a number of edges of the tile) extending in a longitudinal direction L perpendicular to the thickness direction. The first tile 15 also has a lower surface S intended to be in contact with, and advantageously fixed to the surface 10 in the example.

The second tile 20 is analogous to the first tile 15 in terms of layers and composition of the layers. The second tile 20 only differs in the shape of its core layer 22. The second tile 20 has a second edge 32 (same remark: "second" refers here to the first tile).

The core layer 22 of the first tile 15 defines a connecting groove 28 in the first edge 26, and the lower surface S defines an additional groove 30 approximately parallel to the the longitudinal direction L.

The core layer 22 of the second tile 20 defines a connecting tongue 34 protruding from the second edge 32, and adapted to be snap-fit into the connecting groove 28 in a connecting direction C perpendicular to the longitudinal direction L and to the thickness direction V in order to obtain the locked configuration.

The first edge 26 comprises an upper part 36, for example parallel to the thickness direction V, and adapted to abut against an upper part 38 of the second edge 32 in the locked configuration.

With respect to the second edge 32, the connecting tongue 34 comprises a distal part 40 forming a nose converging towards a distal extremity 42, and a proximal part forming a neck.

The distal extremity 42 is for example flat and parallel to the thickness direction V.

The connecting groove 28 has a depth D1 in the connecting direction C, for example comprised between 0.5 and 3 mm. The depth D1 is for example measured from the upper part 26 of the first edge 26.

Successively in the connecting direction C, the connecting groove 28 comprises a bottom 46, an intermediate part 48 configured to be in contact with the connecting tongue 34 in the locked configuration, and a mouth 50.

The bottom 46 is for example situated approximately in the middle of the core layer 22 in the thickness direction V.

The bottom 46 advantageously has a "U"-shaped profile 52 as seen in the longitudinal direction L, said "U" opening toward the first edge 26.

The profile 52 has a lower side 54, and a distal side 56 with respect to the first edge 26.

The lower side 54 is located at a reference distance D2 from the lower surface S in the thickness direction V away from the additional groove 30.

The distal side 56 defines a reference plane P0 perpendicularly to the connecting direction C.

The intermediate part 48 defines a lower contact surface 58 and an upper contact surface 60 both adapted to be at least partly in contact with the connecting tongue 34 in the locked configuration. The contact is advantageously close.

The lower contact surface 58 has a lowermost point S1 in the thickness direction V. The lower contact surface 58 has a locking part 62 on the left of the lowermost point S1 in FIG. 2, adapted to abut against a matching surface 64 of the connecting tongue 34 when the second tile 20 is moved away from the first tile 15 in the connecting direction C starting from the locked configuration. The lower contact surface 58 also has a blocking part 66 adapted to abut against a matching surface 68 of the connecting tongue 34 when the second tile 20 is moved toward the first tile 15 in the connecting direction C starting from the locked configuration.

Advantageously the locking surface 62 and the blocking surface 66 are in contact respectively with said matching surfaces 64, 68 in the locked configuration. The locking surface 62 and the blocking 66 surface are also advantageously inclined with respect to the thickness direction V and are adapted to block the connecting tongue 34 with respect to the connecting groove 28 in the locked configuration when a pressure P (shown in FIG. 1, for example the weight of a person or an object, not shown) is applied on the upper layers 24 of the first tile 15 in the thickness direction V toward the connecting groove 34.

The mouth 50 is adapted to facilitate the entrance of the connecting tongue 34 into the connecting groove 28. For example, the mouth 50 is provided with a chamfer.

The additional groove 30 is located at a distance D3 from the first edge 26, the distance D3 being smaller than twice the depth D1 of the connecting groove 28.

The additional groove 30 has a depth D4 in the thickness direction V, said depth D4 being for example smaller than 75% of the reference distance D2.

The additional groove 30 for example has a "U"-shaped profile 70 in section perpendicularly to longitudinal direction L.

The "U"-shaped profile 70 has a distal side 72 with respect to the first edge 26 in the connecting direction C, the distal side being located between a first plane P1 and a second plane P2 both parallel to the reference plane P0 (i.e. perpendicular to the connecting direction C).

The second plane P2 contains the lowermost point S1. The first plane P1 is situated at the reference distance D2 from the reference plane P0, the reference plane P0 being in between the first plane P1 and the second plane P2.

In order to use the set 1, the first tile 15 and the second tile 20 are put in the locked configuration by snap-fitting the connecting tongue 34 into the connecting groove 28 in the connecting direction C. This can be performed with a reasonable insertion effort, advantageously lower than 6 kN/m.

The insertion effort is given in kN/m because it is proportional to the length (in m) of the edges 26, 32 to be connected.

In absence of the additional groove 30, the insertion effort would be much higher.

Thanks to the above features, the set 1 is easy to use, while remaining simple to produce, and cost effective.

Figure 3:
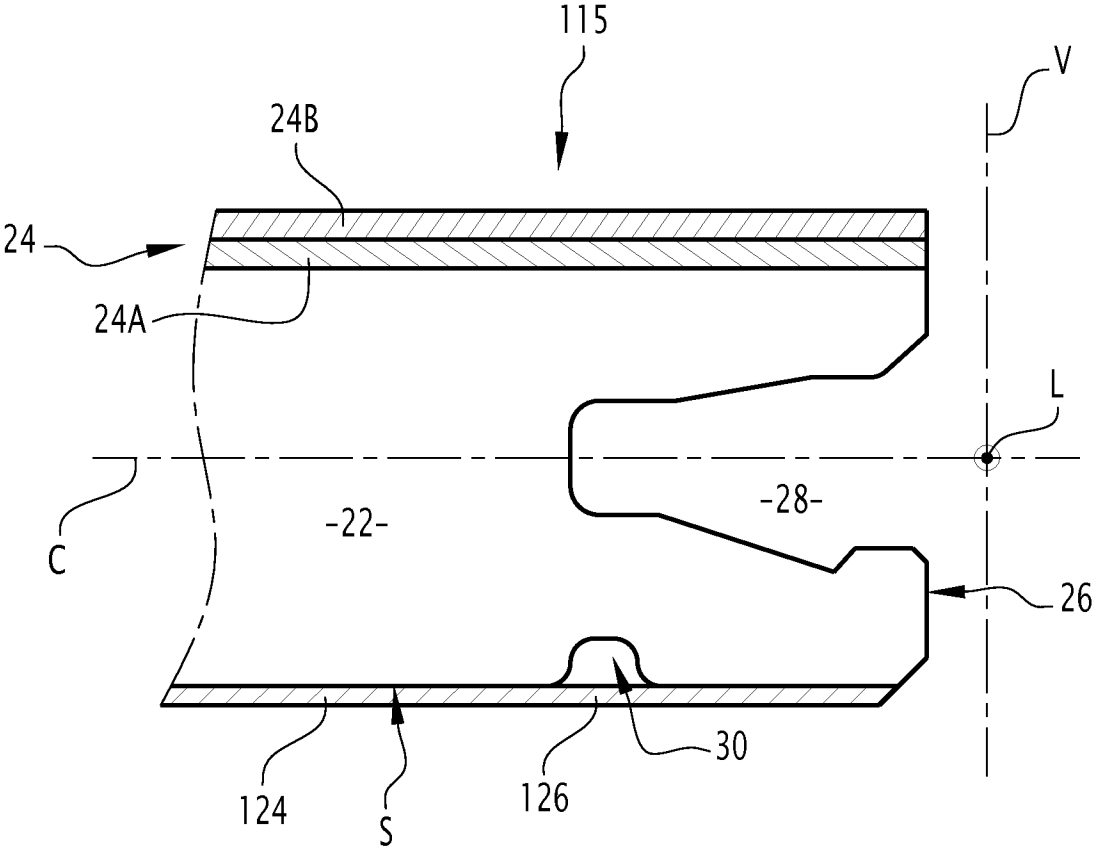
FIG. 3 is a schematic cross-sectional view of a first tile according to a variant of the first tile represented in FIGS. 1 and 2.

In reference to FIG. 3, a tile 115 constituting a variant of the first tile 15 will be described. The tile 115 is analogous to the first tile 15 shown in FIGS. 1 and 2. Similar elements bear the same numeral references and will not be described again. Only the differences will be described in detail.

The tile 115 has a backing layer 124 fixed to lower surface S of core layer 22.

The backing layer 124 is adapted to be fixed to the surface 10.

In a particular embodiment, the backing layer 124 has a flat portion 126 which covers the additional groove 30 like a bridge.

In another embodiment (not shown), the backing layer 124 leaves the groove 30 uncovered.

The invention claimed is:

1. A set of tiles adapted to cover a surface perpendicular to a thickness direction of the tiles, each of the tiles comprising at least one upper layer, and an underlying rigid core layer, the core layer and the upper layer being superimposed in the thickness direction, and the core layer defining a lower surface opposite the upper layer, wherein:

said tiles comprising at least one first tile having a first edge extending in a longitudinal direction, the core layer of the first tile defining a connecting groove in the first edge, and at least one second tile having a second edge extending in the longitudinal direction, the core layer of the second tile defining a connecting tongue protruding from the second edge, the connecting tongue being adapted to be snap-fit into the connecting groove in a connecting direction perpendicular to the longitudinal direction and to the thickness direction in a locked configuration of the first tile and the second tile, the lower surface defines an additional groove parallel to the first edge, and the core level has a rigidity represented by an angle, the angle being less than or equal to 2°, and the angle being measured by a process comprising;

preparing a sample, wherein the sample has the same material and the same thickness as the core layer, and the sample is rectangular and measures 450 mm×160 mm, and blocking a rectangular part of the sample in between a horizontal support and a weight of 5 kg in an atmosphere regulated at 23° C.+/−2° C., with a remaining part of the sample being delimited by a linear edge of the support, wherein the remaining part measures 300 mm×160 mm, is horizontal at an initial time, is cantlivered, and flexes downwards under its own weight, wherein a lowest point of the remaining part and the linear edge define the angle with respect to a horizontal direction, and the angle is measured 30 seconds after the initial time.

2. The set according to claim 1, wherein the core layer comprises a thermoplastic material.

3. The set according to claim 2, wherein the thermoplastic material comprises PVC.

4. The set according to claim 1, wherein the connecting groove has a depth in the connecting direction, the additional groove being located at a distance from the first edge, the distance being smaller than twice the depth.

5. The set according to claim 1, wherein the additional groove has a "U"-shaped profile in section perpendicularly to the longitudinal direction.

6. The set according to claim 1, wherein the connecting groove comprises a bottom having a "U"-shaped profile seen in the longitudinal direction, said "U" opening toward the first edge.

7. The set according to claim 6, wherein said "U"-shaped profile of the bottom of the connecting groove has a lower side located at a reference distance from the lower surface in the thickness direction away from the additional groove, the additional groove having a depth in the thickness direction, said depth being smaller than 75% of said reference distance.

8. The set according to claim 7, wherein:

the additional groove has a "U"-shaped profile having a distal side with respect to the first edge in the connecting direction, the connecting groove defines a lower contact surface adapted to be at least partly in contact with the connecting tongue in the locked configuration, the lower contact surface having a lowermost point in the thickness direction, said "U"-shaped profile of the bottom of the connecting groove has a distal side defining a reference plane perpendicularly to the connecting direction, and the distal side of the "U"-shaped profile of the additional groove is located between a first plane and a second plane both parallel to the reference plane, the second plane containing the lowermost point, the reference plane being located in between the first plane and the second plane, and the first plane being located at said reference distance from the reference plane.

9. The set according to claim 1, wherein:

the connecting groove defines a lower contact surface adapted to be at least partly in contact with the connecting tongue in the locked configuration, and the lower contact surface of the connecting grove has a locking part adapted to abut against a matching surface of the connecting tongue when the second tile is moved away from the first tile in the connecting direction starting from the locked configuration.

10. The set according to claim 9, wherein:

the lower contact surface of the connecting groove also has a blocking part adapted to abut against a matching surface of the connecting tongue when the second tile is moved toward the first tile in the connecting direction starting from the locked configuration, the locking part and the blocking part: are in contact respectively with said matching surfaces in the locked configuration, and the locking part and the blocking part are inclined with respect to the thickness direction so as to block the connecting tongue with respect to the connecting groove in the locked configuration when a pressure is applied on the upper layer of the first tile in the thickness direction toward the connecting groove.

11. The set according to claim 1, wherein the core layer contains no plasticizer, or less than 5 wt % of plasticizer.

12. The set according to claim 1, wherein the at least one upper layer is a decorative layer located on the core layer, wherein the tiles further comprise:

a wear layer located on the decorative layer.

13. A method of covering a surface with tiles, the surface being perpendicular to a thickness direction of the tiles, comprising:

providing a set according to claim 1, and putting the first tile and the second tile in the locked configuration by snap-fitting the connecting tongue into the connecting groove in the connecting direction.

14. The set according to claim 12, wherein the tiles further comprise a backing layer fixed to the core layer opposite the decorative layer.

15. The set according to claim 14, wherein the backing layer of the first tile comprises a flat portion covering the additional groove like a bridge.

* * * * *